US009016840B2

(12) United States Patent
Kabalnov

(10) Patent No.: US 9,016,840 B2
(45) Date of Patent: Apr. 28, 2015

(54) LIQUID DELIVERY SYSTEM

(75) Inventor: Alexey S. Kabalnov, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 409 days.

(21) Appl. No.: 13/259,646

(22) PCT Filed: Apr. 30, 2009

(86) PCT No.: PCT/US2009/042450

§ 371 (c)(1), (2), (4) Date: Sep. 23, 2011

(87) PCT Pub. No.: WO2010/126526

PCT Pub. Date: Nov. 4, 2010

(65) Prior Publication Data

US 2012/0033022 A1 Feb. 9, 2012

(51) Int. Cl.
*B41J 2/175* (2006.01)
*B41J 2/17* (2006.01)

(52) U.S. Cl.
CPC ..... *B41J 2/17513* (2013.01)

(58) Field of Classification Search
USPC ..... 347/84, 85
See application file for complete search history.

(56) References Cited

U.S. PATENT DOCUMENTS

| | | | | |
|---|---|---|---|---|
| 4,191,302 | A | 3/1980 | Fiducia | |
| 5,973,027 | A | 10/1999 | Howald et al. | |
| 6,386,750 | B2 | 5/2002 | Marelli | |
| 6,488,348 | B1 | 12/2002 | Miura et al. | |
| 7,097,287 | B2 | 8/2006 | Nakao et al. | |
| 2001/0008218 | A1 * | 7/2001 | Chau | 210/278 |
| 2003/0044322 | A1 | 3/2003 | Andersson et al. | |
| 2005/0083379 | A1 * | 4/2005 | Chikamoto | 347/68 |
| 2009/0096842 | A1 * | 4/2009 | Kubo et al. | 347/68 |

* cited by examiner

*Primary Examiner* — Jannelle M Lebron

(57) ABSTRACT

A liquid storage container (12, 112, 312, 412) is configured to store a liquid suspension (14) having a liquid vehicle (18) and suspended particles (16). The liquid storage container (12, 112, 312, 412) includes vertically stacked stories (30) and at least one shaft (32) interconnecting the stories (30).

17 Claims, 4 Drawing Sheets

LIQUID DELIVERY SYSTEM

BACKGROUND

Liquid suspensions include a liquid vehicle and suspended particles. If the density of the particles is larger than the density of the fluids, the suspended particles may settle from the liquid vehicle. The settled particles may clog or occlude liquid conduits and may detrimentally impact quality or performance.

DETAILED DESCRIPTION OF THE EXAMPLE EMBODIMENTS

Figure 1:
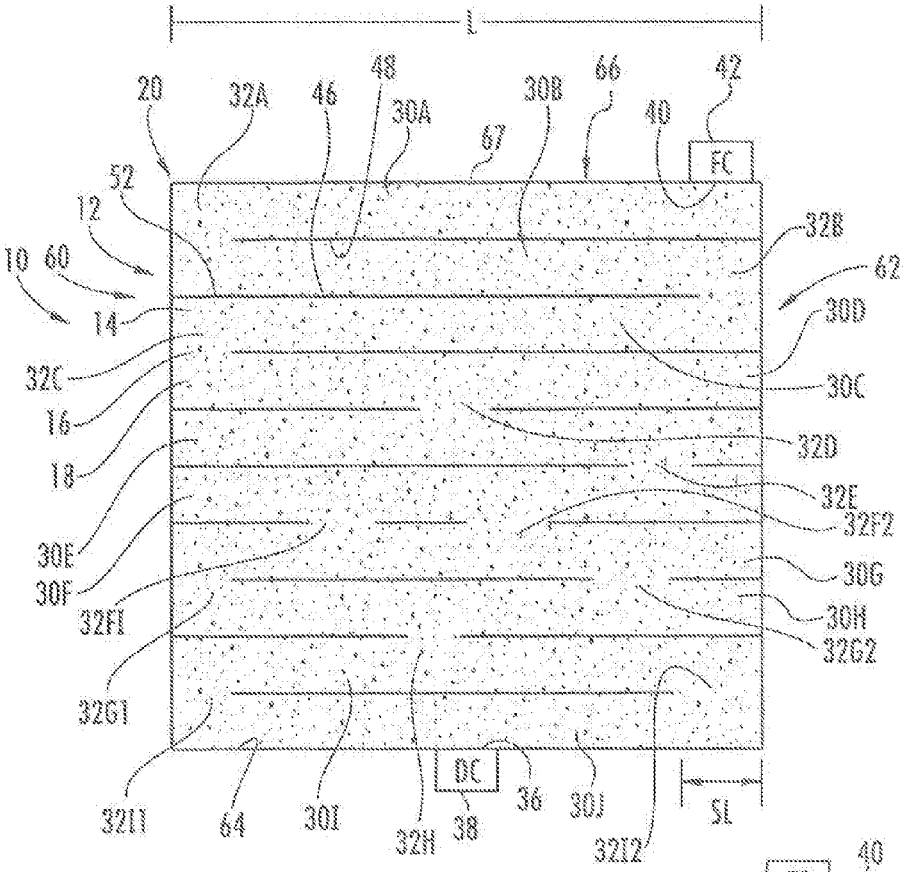
FIG. 1 is a front sectional view schematically illustrating a liquid supply of a liquid delivery system according to an example embodiment.
Figure 2:
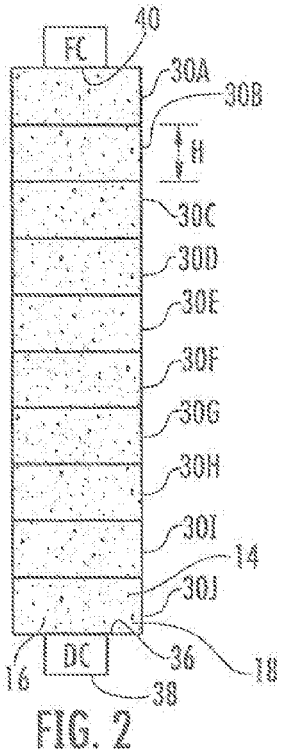
FIG. 2 is a side of sectional view schematically illustrating the liquid supply of FIG. 1 according to an example embodiment.

FIGS. 1 and 2 are sectional views schematically illustrating part of a liquid delivery system 10 comprising a liquid supply 12 according to an example embodiment. Liquid delivery system 10 delivers or utilizes liquid 14 provided by liquid supply 12. Liquid 14 comprises a liquid suspension having one or more particles 16 suspended in a liquid carrier or liquid vehicle 18. Examples of liquid 14 include, but are not limited to, various pigment inks, wherein pigment particles (such as black, cyan, magenta and yellow) are suspended in a liquid vehicle. Over time, particles 16 may settle from the liquid vehicle 18.

In addition to liquid 14, liquid supply 12 further comprises a liquid storage container 20 which statically stores liquid 14 until used by delivery system 10. The term "statically stores" means that the liquid is stored in a static fashion. In other words, until liquid 14 is drawn from liquid storage container 20 for use by delivery system 10, liquid 14 does not circulate or flow within liquid storage container 20. As will be described hereafter, liquid storage container 20 is configured so as to either reduce a rate at which particles 16 settle from liquid vehicle 18 or the rate at which particles 16 settle at a bottom of container 20 proximate a discharge port of container 20. As a result, the concentration of suspended particles 16 in liquid 14 flowing from container 20 is higher and container 20 reduces the likelihood of settled particles 16 being discharged from container 20 to downstream locations where the settled particles 16 may clog liquid conduits and may detrimentally impact performance.

Liquid storage container 20 generally comprises a plurality of vertically stacked stories 30A, 30B, 30C, 30D, 30E, 30F, 30G, 30H and 30I (collectively referred to as stories 30), a plurality of shafts 32A, 32B, 32C, 32D, 32E, 32F1, 32F2, 32G1, 32G2, 32H, 32I1 and 32I2 (collectively referred to as shafts 32), drain port 36, drain closure 38, fill port 40 and fill closure 42. Each story 30 comprises a generally horizontal (perpendicular to the direction of gravity) section of container 20 providing a volume having a horizontal dimension greater than a vertical dimension. Each story 30 has a volume defined by a floor 46 and a ceiling 48. Floor 46 serves as a bottom surface while ceiling 38 serves as a top surface of the volume of each story. In the example illustrated, container 20 includes a multitude of partitions or dividers 52, wherein each partition or divider 52 provides a floor 46 for an overlying story 30 and a ceiling 48 for an underlying story 30. In such an embodiment, each partition 52 has a thickness as small as possible. As a result, liquid storage container 20 is more compact and space efficient. In other embodiments, the floor of an overlying story 30 and a ceiling of an underlying adjacent story may be provided by separate and distinct partitions or dividers 52 which are vertically spaced from one another. For example, stories 32 may alternatively be formed by a leftward and rightward substantially horizontally meandering tube or hose, wherein interior surfaces of the tube form both the floor and the ceiling of a particular story and wherein the outer surfaces of the tube do not serve as a floor or ceiling.

As shown in FIG. 1, in the example illustrated, floors 46 and ceilings 48 comprise horizontal surfaces. In the example illustrated, floors 46 and ceilings 48 comprise nearly perfectly horizontal surfaces. In other embodiments, floors 46 and ceilings 48 may alternatively comprise substantially horizontal surfaces. For purposes of this disclosure, with respect to the orientation of stories, floors or ceilings, the term "substantially horizontal" encompasses perfectly horizontal structures or volumes as well as structures or volumes that generally extend in a horizontal direction (i.e. with a tolerance of ±3 degrees). For example, the term "substantially horizontal story" or "substantially horizontal stories" encompasses stories that may undulate along portions, but which do not uniformly or consistently decline, incline or slope (at the same slope/grade or different slopes/grades) throughout the entire length of a story. For example, a leftward and rightward meandering tube may include undulating portions. However, an entire length of the tube forming a substantially horizontal single story does not uniformly or consistently slope along its entire length of the story. The term "substantially horizontal" would exclude a helical conduit or helical channel as a helical conduit or channel declines along its entire length. The same meaning applies to floors and ceilings.

Stories 32 are vertically stacked. For purposes of this disclosure, the term "vertically stacked" means that at least portions of consecutive stories 30 directly overly or underlie one another. In other words, a vertical line (perpendicular to the direction of gravity) passing through a floor 46 of one story intersects the floor 46 of another underlying story 30 or another overlying story 30. In the example illustrated, each of stories 30A-30J are vertically stacked in that a single vertical line may be drawn which would intersect the floor of each story. In the example illustrated, liquid storage container 20 has left and right vertical sides between which stories 30 are contained or are bound (i.e. the stories 30 terminate along same vertical edges or sides of container 20). As a result, the storage container 20 is compact and space efficient. In other embodiments, stories 30 may be arranged such that one story may horizontally extend to a greater extent or distance to the left or right (as seen in FIG. 1) as compared to another one of stories 30. For example, stories 30 may be arranged in a stair-step configuration or may include horizontally longer stories and horizontally shorter stories.

As shown by FIG. 2, in the example illustrated, stories 30 are arranged in a same plane. Stories 30 extend from a left end 60 (as seen in FIG. 1) to a right end 62 (as seen in FIG. 1). As a result, liquid storage container 20 is compact and space efficient. In other embodiments, liquid storage container 20 may alternatively have stories which are not aligned in a same plane, wherein the stories wind or are at least partially offset with respect to one another from a top-down perspective. In one embodiment, consecutive or adjacent stories 32 may vertically overlap one another merely at an interconnecting shaft 32. In one embodiment, each story 30 may be oriented at an angle with respect to an adjacent underlying or overlying story, wherein the stories form a polygonal flow path. For example, in one embodiment, consecutive stories 30 may be angled at 90 degrees with respect to one another, wherein liquid storage container is in the form of a hollow rectangle, four consecutive stories forming four consecutive sides of the rectangle. In another embodiment, each story may be in the shape of a circle, oval or other shape, wherein the floor of each story is at least substantially horizontal.

As further shown by FIG. 2, each story has a height H, the vertical distance separating the surface of floor 46 and the surface of ceiling 48. The height H of each floor 30 is less than about $3\ KT/4\pi\Delta\rho gr^3$, where:

K=Boltzmann constant;

T=absolute temperature of liquid 14;

$\Delta\rho$=effective difference between a density of the particle 16 and a density of liquid vehicle 18;

g=acceleration of gravity; and r=is the equivalent spherical radius of a single particle 16

$\pi$~3.14 is the 'pi number, which is the ratio of the circumference of a circle to its diameter.

For non-spherical particles, the equivalent spherical radius of the particle is defined as the radius of a sphere that has the same volume as the particle. It is also understood that the dispersion of the particles in the fluid may have a continuous distribution of particle sizes. In this case, r is the weight-average particle radius that can be measured by various particle sizing techniques known in art, such as dynamic and static light scattering, or electron microscopy.

It should be understood that the dispersed particles can have a complex structure, for example, they may have pores and holes. Alternatively, particles may contain polymeric encapsulating layers around them. All these features are expected to affect the effective density differential between the particles and the medium. There are methods to measure the effective density differential between the particles and the medium, such as ultracentrifugation, or electro-acoustic methods. Thus, in the study of R. W. O'Brian 'Attenuation and electro-acoustic measurements of porous particles' presented at Particles 2003 Symposium in Toronto, 2003, it was shown that the effective density of carbon black particles used for ink-jet is about 1.3- 1.4 g/cm$^3$, which is less than that of the true carbon black, which is about 1.8 g/cm$^3$.

In dispersions, the particles undergo the processes of random Brownian motion and gravity-driven settling, as discussed in many textbooks, see, for example, W. B. Russel, D. A. Saville and W. R. Schowalter, Colloidal Dispersions, Cambridge University Press, 1989. The average displacement of particles as caused by diffusion increases as the square root of time, while the average displacement as caused by settling increases as a linear function of time. For a fixed time, diffusion dominates over settling at shorter displacement distances. The height of each floor is chosen in such a way that Brownian motion of dispersed particles overwhelms settling. As a result, settling of particle 16 from liquid vehicle 18 is slowed. This reduction in settling is independent of any flow of liquid 14 during draining of liquid 14 from container 20. Because the rate at which particles 16 settle from liquid vehicle 18 and the rate at which settled particles 16 accumulate along the bottom surface 64 of container 20 adjacent to drain port 36 is reduced, the concentration of suspended particles 16 in liquid 14 flowing from container 20 is higher and container 20 reduces the likelihood of settled particles 16 being discharged from container 20 to downstream locations where the settled particles 16 may clog liquid conduits and may detrimentally impact performance.

In one embodiment, each story has a height H of less than or equal to about 1 cm to reduce settling. In another embodiment, each story has a height H of less than or equal to about 3 mm. In other embodiments, stories 30 may have heights H of less than or equal to about 0.3 mm or even 0.1 mm. According to one embodiment, liquid storage container 20 contains a carbon black, text K pigment ink having a weight-average equivalent sphere particle diameter of approximately 120 nm, and effective density differential of 0.4 g/cm$^3$. In such an embodiment, each story 30 has a height H of less than or equal to about 5 mm. In embodiments where liquid container 20 stores particle having a smaller diameter of 90 nm and about the same effective density differential, such as cyan, magenta or yellow color pigments, each story 30 may have a height of less than or equal to about 10 mm. In other embodiments where liquid storage container 20 stores pigment inks having larger particle sizes or more dense particles, such as white titania-based inks with the pigment density of 4 g/cm$^3$ and the particle size of 200 nm, floors 30 have a height H of less than or equal to about 0.1 millimeters.

In a sample illustrated, each story 30 has a length L (shown in FIG. 1) and a depth D (shown FIG. 2). The length L may have a variety of values depending upon a desired storage volume/capacity and available space or footprint for liquid storage container 20. The depth D in combination with the height H provides a cross-sectional area of each story 30. According to one embodiment, the cross-sectional area of the story is at least about 0.1 cm$^2$. As a result, liquid 14 maybe drained or removed from liquid storage container 20 at a sufficient rate for use by liquid delivery system 10. In other embodiments, stories 30 may have other cross-sectional areas.

Shafts 32 comprise passages fluidly connecting consecutive stories 30. Shafts 32 permit liquid 14 to flow from one story to another story as liquid 14 is being drawn or drained from container 20. In the example illustrated, each shaft 32 comprises an aperture extending through divider 52, extending through the floor 46 of an overlying story and extending through the ceiling 48 of an underlying story 30. Each of shafts 32 has a length and cross-sectional area or opening size sufficiently large to accommodate a desired flux or rate of flow of liquid 14 out of container 20. In other words, the opening size of each of shafts 32 should be sufficiently large to provide an acceptable hydrodynamic resistance. At the same time, each of shafts 32 has a length and cross-sectional area or opening sized as small as possible to reduce settling of particles 16. In one embodiment, each of shafts 32 has a shaft length SL of between about 0.01 L to about 0.3 L and nominally of between about 0.03 L to about 0.1 L.

As shown by FIG. 2, shafts 32 may be provided at a multitude of different locations. In the example illustrated, shafts 32A, 3213 and 32C are located at horizontal ends of stories 30A, 30B and 30C, respectively. Shaft 32D is located at an intermediate location between horizontal ends of story 30D. Likewise, shafts 32E is at an intermediate location between ends of story 30E distinct from or horizontally offset from the intermediate location of shafts 32D. In the example illustrated, stories 30F and 30G are connected by a pair of shafts 32F1 and 32F1, both located at intermediate locations along story 30F. Shafts 32G1 and 32G2 connect stories 30G and 30H. Shafts 32G1 is at a horizontal end of story 30G while shaft 32G2 is at an intermediate location along story 30G. Shaft 32H connects stories 30H and 30I and is at an intermediate location between horizontal ends of story 30H. Lastly, shafts 32I1 and 32I2 connect story 30I and story 30J. Shafts 32I1 and 32I2 are located at opposite horizontal ends of story 30I. In the example illustrated, those stories connected to one another by a single shaft 32 may have reduced settling of particles 14 as compared to those stories that are connected by multiple shafts 32 having a collective larger opening size. In embodiments where the total opening size of multiple shafts 32 connecting two consecutive stories 30 is the same as the area or size of the opening of a single shaft connecting two consecutive stories 30, settling characteristics may be similar.

Although container 20 is illustrated as having 10 stories, in other embodiments, container 20 may have greater or fewer than 10 stories depending upon a desired capacity of storage container 20. Although container 20 is illustrated as having either one or two shafts 32 connecting consecutive stories, in other embodiments, greater than two shafts may be employed to connect two consecutive stories. Although container 20 is illustrated as having shafts 32 at a variety of different shaft locations, in other embodiments, container 20 may alternatively have shafts 32 alternating between two shaft locations between all the stories 30. Although shafts 32 are illustrated as comprising openings in divider 52, in other embodiments, shafts 52 may be formed by bends in a tube. Shafts 32 may also comprise vertical tubes extending between stories. Although shafts 32 are illustrated as extending substantially perpendicular to stories 30, in other embodiments, shafts 32 may alternatively extend at oblique angles with respect to the substantially horizontal direction or orientation of stories 30 or the direction of gravity.

Drain port 36 comprises an opening through the floor 46 of the lowermost story 30 of container 20. Drain port 36 extends through bottom 64 of container 20. Drain port 36 provides an opening or passage through which liquid 14 may be drained or otherwise discharged from container 20 by delivery system 10.

In one embodiment, each story has a height H of less than or equal to about 1 cm to reduce settling. In another embodiment, each story has a height H of less than or equal to about 3 mm. In other embodiments, stories 30 may have heights H of less than or equal to about 0.3 mm or even 0.1 mm. According to one embodiment, liquid storage container 20 contains a carbon black, text K pigment ink having a weight-average equivalent sphere particle diameter of approximately 120 nm, and effective density differential of 0.4 g/cm.sup.3. In such an embodiment, each story 30 has a height H of less than or equal to about 5 mm. In embodiments where liquid container 20 stores particles having a smaller diameter of 90 nm and about the same effective density differential, such as cyan, magenta or yellow color pigments, each story 30 may have a height of less than or equal to about 10 mm. In other embodiments where liquid storage container 20 stores pigment inks having larger particle sizes or more dense particles, such as white titania-based inks with the pigment density of 4 g/cm.sup.3. and the particle size of 200 nm, floors 30 have a height H of less than or equal to about 0.1 millimeters.

Fill port 40 comprises an opening or aperture through which the interior container 20 is filled with liquid 14. In the example illustrated, fill port 40 is located at a top 66 of container 20, extending into story 30A. Fill closure 38 comprises a member or mechanism configured to include or plug fill port 40. In yet other embodiments, fill port 40 may be omitted, wherein container 20 is filled through drain port 36 such as when container 20 is inverted for filling. In some embodiments, container 20 may additionally include a vent 67, allowing air to enter into the interior of container 20 thus facilitate draining of liquid 14 from container 20.

Overall, liquid storage container 20 provides a liquid delivery system 10 with a passive settling reduction solution. In particular, liquid storage container 20 reduces settling of particles 16 to reduce reliance on any moving parts or to omit moving parts. As a result, liquid storage container 20 is well-suited for prolonged unattended storage of liquid 14, such as storage on a shelf of a warehouse or in applications where the device to receive or use liquid 14 is unpowered or is stored.

As shown by FIG. 2, shafts 32 may be provided at a multitude of different locations. In the example illustrated, shafts 32A, 3213 and 32C are located at horizontal ends of stories 30A, 30B and 30C, respectively. Shaft 32D is located at an intermediate location between horizontal ends of story 30D. Likewise, shaft 32E is at an intermediate location between ends of story 30E distinct from or horizontally offset from the intermediate location of shafts 32D. In the example illustrated, stories 30F and 30G are connected by a pair of shafts 32F1 and 32F1, both located at intermediate locations along story 30F. Shafts 32G1 and 32G2 connect stories 30G and 30H. Shafts 32G1 is at a horizontal end of story 30G while shaft 32G2 is at an intermediate location along story 30G. Shaft 32H connects stories 30H and 30I and is at an intermediate location between horizontal ends of story 30H. Lastly, shafts 32I1 and 32I2 connect story 30I and story 30J. Shafts 32I1 and 32I2 are located at opposite horizontal ends of story 30I. In the example illustrated, those stories connected to one another by a single shaft 32 may have reduced settling of particles 14 as compared to those stories that are connected by multiple shafts 32 having a collective larger opening size. In embodiments where the total opening size of multiple shafts 32 connecting two consecutive stories 30 is the same as the area or size of the opening of a single shaft connecting two consecutive stories 30, settling characteristics may be similar.

Print head 170 (schematically illustrated) comprises one or more drop-on-demand inkjet print heads configured to selectively eject or fire droplets of liquid or liquid suspension 14 in response to elecrical current or electrical signals from a controller (not shown). In one embodiment, print head 170 comprises a drop-on-demand thermoresistive inkjet actuator, wherein a thin film resistor of actuator 34 heats to temperature so as to vaporize a portion of fluid within chamber 30 to create bubble that expels fluid through nozzle 32. In another embodiment, fluid actuator 34 comprises a drop-on-demand piezo resistive actuator or inkjet dispenser, wherein a piezoelectric film undergoes a change in shape or expands so as to change a volume of chamber 30 and to expel fluid through nozzle 32.

Print head 170 is permanently joined and connected to liquid supply 112 so as to form a drop-on-demand inkjet print cartridge 172. Print cartridge 172 is configured to be removably inserted into a printer for printing the pigment ink 14 onto a medium. In other embodiments, liquid storage container 112 may alternatively store and supply to print head 170 a different liquid suspension 14 having particles which are to be printed in the form of a pattern or image on a substrate. For example, in some embodiments, liquid storage container 112 of print cartridge 172 may alternatively include a liquid suspension having particles 14 which are to be used to print one more layers or parts of a transistor, a micro-electro-mechanical machine or MEMs device, or other electronic or micro devices. Because print cartridge 172 utilizes liquid supply 112 having container 20, print cartridge 172 provides a liquid 14 with less settling of particles 16 from the liquid 14. As a result, print cartridge 172 may be stored in an unused state for longer periods of time without detrimentally impacting printing quality and performance. The printing liquid within print cartridge 172 may also be inserted in a printer for a longer period of time without replacement and with a reduced likelihood that the printing liquid will become unusable as a result of settling of particles in the printing liquid.

Figure 4:
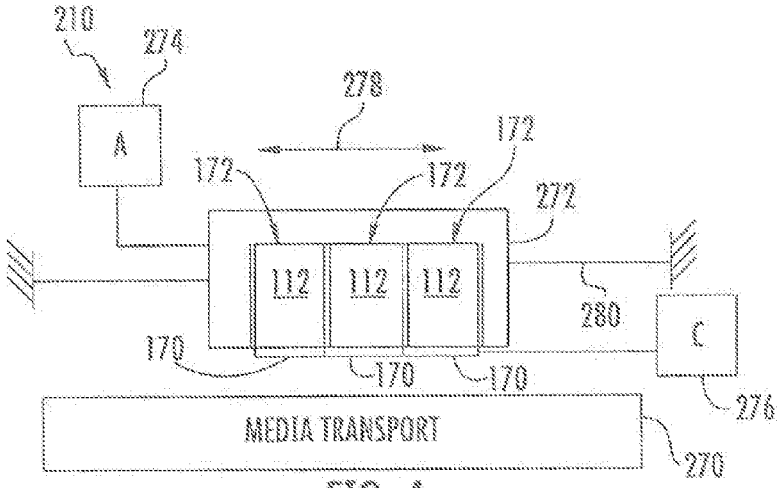
FIG. 4 is a schematic illustration of a liquid delivery system including a plurality of the print cartridges of FIG. 3 according to an example embodiment.

FIG. 4 schematically illustrates liquid delivery system 210. Liquid delivery system 210 delivers a liquid suspension to a print media or substrate. Liquid delivery system 210 includes media transport 270, carriage 272, print cartridges 172, actuator 274 and controller 276. Media transport 270 comprises a mechanism configured to position a sheet or web of print media or a substrate opposite to print cartridges 172. In one embodiment, media transport 270 may comprise one or more belts, rollers or movable trays/tables. In other embodiments, other media movement devices may be employed.

Figure 3:
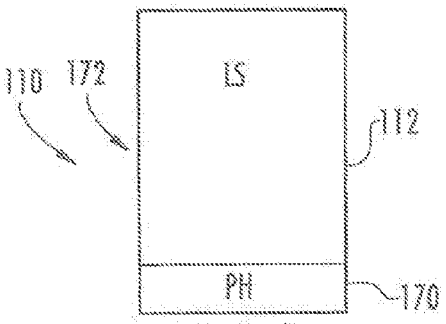
FIG. 3 is a schematic illustration of a print cartridge of a liquid delivery system including the liquid supply of FIG. 1 according to an example embodiment.

Carriage 272 comprises a structure configured to removably receive and carry one or more print cartridges 172 across print media supported by media transport 270. In the example illustrated, carriage 272 is illustrated as supporting three print cartridges 172, each print cartridge 172 containing a different pigment ink. In other embodiments, carriage 272 may support greater fewer than three of such print cartridges 172. Print cartridges 172 are described in more detail in FIG. 3 above.

Actuator 274 comprises a mechanism configured to move carriage 272 and cartridges 172 in directions indicated by arrows 278. In one embodiment, actuator 274 reciprocates carriage 272 along a guide rod or rail 280. In one embodiment, actuator 274 comprises a belt or pulley connected to carriage 272 and driven by a motor and associated speed reducing transmission. In other embodiments, actuator 274 may have other configurations. In yet other embodiments, actuator 274 and carriage 272 may be omitted, wherein a single cartridge 172 or an array of cartridges 172 collectively span a dimension of media moved by media transport 270 (sometimes referred to as a page-wide-array printer).

Controller 276 comprises one or more processing units configured to generate control signals directing movement of media transport 270 and actuator 274 so as to appropriately position media and print cartridges 172 with respect to one another during printing. Controller 276 is further configured to generate control signals directing ejection of liquid 14 by print head 170 onto the print media. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 276 may be embodied as part of one or more application-specific integrated circuits (ASICs). Unless otherwise specifically noted, the controller is not limited to any specific combination of hardware circuitry and software, nor to any particular source for the instructions executed by the processing unit. During printing, liquid 14 is drawn from liquid supply 112 and be used to print an image or pattern on the print media. Because liquid supply 112 of each print cartridge 172 supplies liquid 14 (a pigment ink) with less settling, print quality and performance may be enhanced.

Figure 5:
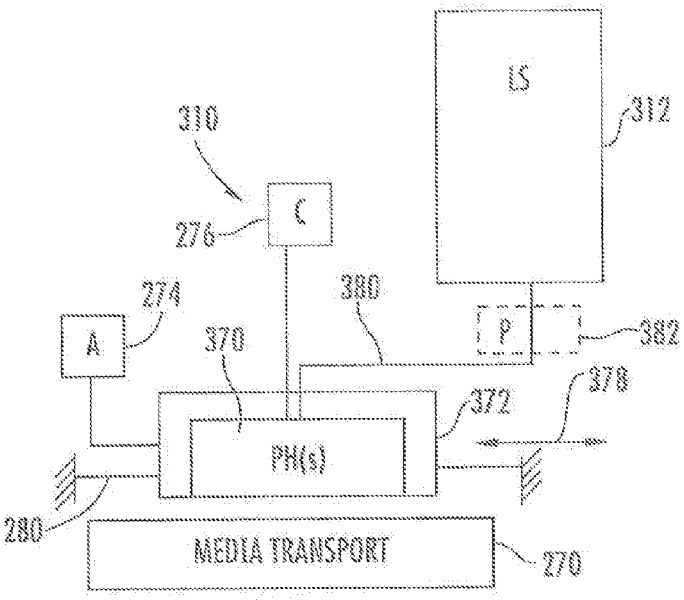
FIG. 5 is a schematic illustration of another embodiment of the liquid delivery system of FIG. 4 including the liquid supply of FIG. 1 according to an example embodiment.

FIG. 5 schematically illustrates liquid delivery system 310, another embodiment of the delivery system 210. Liquid delivery system 310 comprises a printer utilizing an off-axis supply of printing liquid. Liquid delivery system 310 includes media transport 270, carriage 372, actuator 274, print head 370, liquid supply 312 and controller 276. Media transport 270 is described above with respect to FIG. 4. Media transport 270 positions a print media or substrate opposite to print head 370. Carriage 372 is similar to carriage 272 (shown in FIG. 4) except that carriage 372 moves and positions one of more print heads 370 with respect to a print media supported by media transport 270. Although carriage 372 may additionally move smaller volume storage containers associated with print head 370, carriage 372 does not transport or move the larger volume storage of liquid for print head 370 provided by liquid supply 312 which is off-axis. Actuator 274 is described above with respect to FIG. 4. Actuator 274 moves carriage 372 and print head 370 in the direction indicated by arrows 378.

Print head 370 is similar to print head 170 described above except that print head 370 is individually carried by carriage 372. In particular, print head 370 comprises one or more drop-on-demand inkjet print heads, examples of which include a thermoresistive print head or a piezo resistive print head. Although each of the one or more print heads 370 carried by carriage 372 may include a dedicated small volume of liquid, each of print heads 370 is replenished with liquid from liquid supply 312.

Liquid supply 312 is identical to liquid supplied 112 except that liquid supply 312 supplies liquid 14 (a pigment ink or a liquid containing particles to be printed in a pattern or image) to print heads 370 via an elongate conduit 380 which is connected to drain port 36 (shown in FIG. 1). In one embodiment, conduit comprises a flexible tube or hose, wherein the conduit 380 flexible and as the one of more print heads 370 are reciprocated in the directions indicated by arrows 378. In one embodiment, liquid delivery system 310 additionally includes a pump 382 (shown in broken lines). Pump 382 comprises a peristaltic pump or other pumping device configured to move liquid along conduit 380 to the one or more print heads 370. In other embodiments, pump 382 may be omitted. In embodiments where the one or more print heads 370 are stationary or collectively span a dimension of the print media positioned by media transport 270, carriage 372 and actuator 274 may be omitted. In embodiments where the one or more print heads 370 are stationary, conduit 380 may be inflexible.

Controller 276 is described above with respect to FIG. 4. Controller 276 comprises one or more processing units configured to generate control signals directing movement of media transport 270 and actuator 274 so as to appropriately position media and print head 370 with respect to one another during printing. Controller 276 is further configured to generate control signals directing ejection of liquid 14 by print head 370 onto the print media. During printing, liquid 14 is drawn from liquid supply 112 and is used to print an image or pattern on the print media. Because liquid supply 112 supplies liquid 14 (a pigment ink or other liquid vehicle carrying particles) with less settling, print quality and performance may be enhanced.

Figure 6:
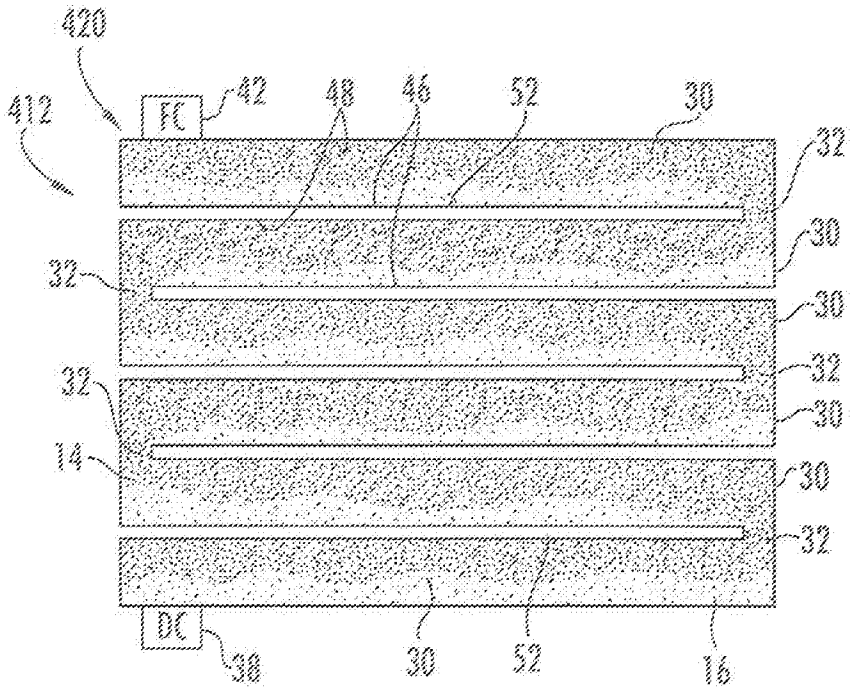
FIG. 6 is a sectional view of another embodiment of the liquid supply of FIG. 1 and illustrating particle settling according to an example embodiment.

FIG. 6 is a sectional view of liquid supply 412, another embodiment of liquid supply 12. Liquid supply 412 comprises liquid 14 (described above with respect to FIG. 1)

stored and contained in liquid storage container 420. Liquid storage container 420 is similar to liquid storage container 20 except that each of the stories 30 are connected to one another by shafts 32 alternating between two shaft locations. In particular, shafts 32 are alternately located opposite horizontal ends of stories 30 such that stories 30 have a "snake" architecture or design. Those elements of liquid storage container 420 which correspond to elements of liquid storage container 20 are numbered similarly. FIG. 6 further illustrates simulated settling of particles 16 of liquid 14 over a time of one-year.

Figure 7:
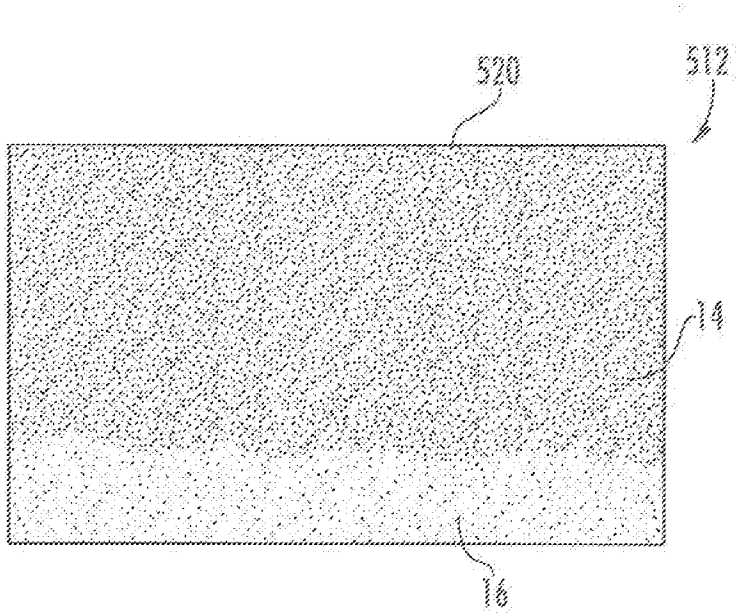
FIG. 7 is a sectional view of a liquid supply having a non-constrained container and illustrating particle settling.

FIG. 7 illustrates an alternative liquid supply 512 having a liquid storage container 520 having an overall capacity or storage volume of the same size or volume as liquid storage container 420. However, liquid storage container 520 is not constrained in that it omits any dividers 52 and omits any stories. As with FIG. 6, FIG. 7 illustrates simulated settling of particles 16 of a same liquid 14 over the same time of one-year. The simulated settling of particles 16 in both FIGS. 6 and 7 was based upon modeling using finite element accounting for pigment settling and diffusion.

Figure 8:
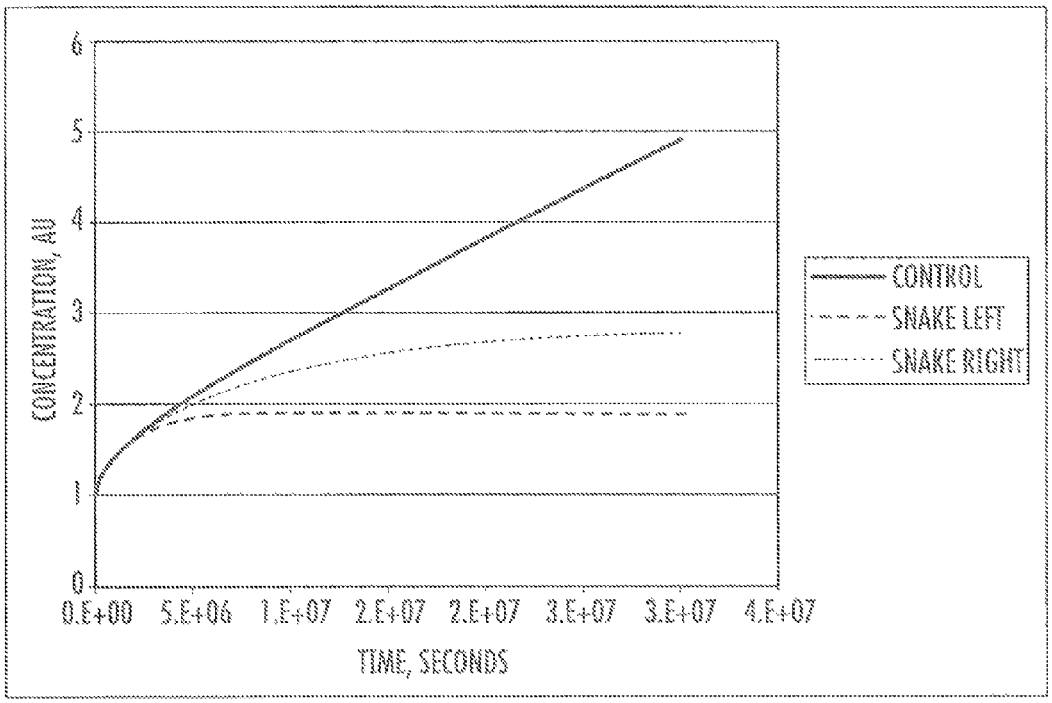
FIG. 8 is a graph comparing particle settling concentration between the liquid supply of FIG. 6 and the liquid supply of FIG. 7 according to an example embodiment.

FIG. 8 is a graph comparing the concentration of accumulation of particles 16 within closed containers 420 and 520 (control) over time. As shown by FIG. 8, the concentration of settled particles 16 (pigment particles in the case of pigment innings) is much lower in both the right side of container 420 and the left side of container 420 as compared to the concentration of particles 16 on the bottom of container 520. It is believed that there is a greater concentration of pigments or particles accumulating on the right side of container 420 as compared to the left side of container 420 due to the larger number of shafts 32 (three) on the right side as compared to the number of shafts 32 (two) on the left side of container 420 and the proximity of such shafts 32. Thus, as shown by the draft of FIG. 8, the inclusion of vertically stacked stories in container 420 reduces the rate at which particles 16, such as pigments, settle from the liquid vehicle 18.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A liquid delivery system comprising:

a liquid storage container configured to store a liquid suspension having a liquid vehicle and suspended particles, the liquid storage container comprising:

vertically stacked stories; and at least one shaft interconnecting the stories, wherein each of the stories has a floor and a ceiling spaced from the floor by distance of less than or equal to about $3KT/4\pi\Delta\rho gr^3$, where:

K=Boltzmann constant;

T=absolute temperature;

$\Delta\rho$=effective difference between a density of the pigment and a density of liquid vehicle;

g=acceleration of gravity;

r=weight-average equivalent radius of particle; and $\pi$~3.14 is the pi number.

2. The liquid delivery system of claim 1, wherein each of the stories has a floor and a ceiling spaced from the floor by a distance of less than or equal to about 10 mm.

3. The liquid delivery system of claim 1, wherein each of the stories has a floor and a ceiling spaced from the floor by distance of less than or equal to about 5 mm.

4. The liquid delivery system of claim 1, wherein each of the stories has a cross-sectional area of at least about 0.1 $cm^2$.

5. The liquid delivery system of claim 1, wherein each of the stories are substantially parallel to one another.

6. The liquid delivery system of claim 1, wherein the at least one vertical shaft is substantial perpendicular to the stories.

7. The liquid delivery system of claim 1 further comprising the liquid suspension stored within the container, wherein the liquid suspension comprises a pigment ink.

8. The liquid delivery system of claim 1 further comprising a valve at a lower end of the container, the valve being actuated between a closed state, allowing the liquid suspension to be stored in the stories and an open state allowing the liquid suspension to drain from the stories.

9. The liquid delivery system of claim 1, wherein the stories include a first story and a second story and wherein the at least one vertical shaft includes a plurality of vertical shafts connecting the first story and the second story.

10. The liquid delivery system of claim 1, wherein the liquid storage container is to statically store the liquid suspension having the liquid vehicle and suspended particles.

11. The liquid delivery system of claim 1, wherein each of the vertically stacked stories comprises a floor and a ceiling and wherein the at least one shaft comprises a shaft interconnecting a first one of the vertically stacked stories and a second one of the vertically stacked stories, wherein the shaft overlies and extends opposite to the floor of the first one of the vertically stacked stories and wherein the shaft underlies and extends opposite to the ceiling of the second one of the vertically stacked stories.

12. The liquid delivery system of claim 1 further comprising a drop-on-demand inkjet print head receiving the liquid suspension from the container.

13. The liquid delivery system of claim 12, wherein the inkjet print head is joined to the liquid storage container so as to form a drop-on-demand inkjet print cartridge.

14. The liquid delivery system of claim 1, wherein the stories include a first story, a second story and a third story, the second story being vertically between the first story and the third story and wherein the at least one vertical shaft comprises:

a first vertical shaft at a first end of the second story connecting the second story and the first story; and a second vertical shaft at a second end of the second story connecting the second story to the third story.

15. The liquid delivery system of claim 1, wherein the stories include a first story, a second story and a third story, the second story being vertically between the first story and the third story and wherein the at least one vertical shaft comprises:

a first vertical shaft at a first intermediate location between a first end of the second story and a second end of the second story, a first vertical shaft connecting the first story and the second story; and a second vertical shaft at a second intermediate location between the first end of the second story and the second end of the second story, the second vertical shaft connecting the second story and the third story, the first intermediate location being horizontal offset from the second intermediate location.

16. The liquid delivery system of claim 1, wherein each of the vertically stacked stories comprise:

a first story having a first story floor and a first story ceiling that form a first volume therebetween; and a second story stacked adjacent to the first story, the second story having a second story floor and a second story ceiling that form a second volume therebetween, wherein the system further comprises the liquid suspension, the liquid suspension continuously extending from the first story floor to the first story ceiling and continuously extending from the second story floor to the second story ceiling such that the liquid suspension fills an entirety of each of the first volume and the second volume.

17. The liquid delivery system of claim 1, wherein the vertically stacked stories comprise:

a first story;

a second story; and a third story second adjacent to and between the first story and the second story, and wherein the at least one shaft comprises:

a first set of one or more shafts comprising every shaft interconnecting the first story and the third story; and a second set of one or more shafts comprising every shaft interconnecting the second story and the third story, wherein each shaft of the first set is horizontally misaligned with respect to each shaft of the second set.

* * * * *